United States Patent [19]

Garner

[11] Patent Number: 4,462,711

[45] Date of Patent: Jul. 31, 1984

[54] REFLECTIVE ROAD MARKER

[76] Inventor: J. Harlan Garner, Rte. 2, Box 215, Gurley, Ala. 35748

[21] Appl. No.: 266,725

[22] Filed: May 26, 1981

[51] Int. Cl.[3] ..... E01F 9/00

[52] U.S. Cl. ..... 404/10; 116/63 R; 40/612

[58] Field of Search ..... 404/10, 15, 16, 11; 116/63 R; 40/606, 607, 608, 611, 612

[56] References Cited

U.S. PATENT DOCUMENTS

| | | | |
|---|---|---|---|
| 1,778,110 | 10/1930 | Hartzler et al. | 116/63 R |
| 1,949,295 | 2/1934 | Dean | 404/11 |
| 2,095,016 | 10/1937 | Waterbor | 404/11 |
| 3,332,327 | 7/1967 | Heenan | 404/16 |
| 3,587,416 | 6/1971 | Flanagan | 404/9 |
| 3,785,719 | 1/1974 | Jonnes | 350/105 |
| 3,879,148 | 4/1975 | Eigenmann | 404/10 |
| 4,111,581 | 9/1978 | Auriemma | 404/10 |
| 4,232,979 | 11/1980 | Johnson, Jr. et al. | 404/16 |

FOREIGN PATENT DOCUMENTS

| | | | |
|---|---|---|---|
| 530277 | 10/1957 | Belgium | 404/10 |
| 2429640 | 1/1975 | Fed. Rep. of Germany | 404/16 |
| 1235337 | 5/1960 | France | 116/63 R |
| 2304722 | 10/1976 | France | 404/10 |
| 1372878 | 11/1974 | United Kingdom | 404/10 |

*Primary Examiner*—William F. Pate, III
*Assistant Examiner*—Mark J. DelSignore
*Attorney, Agent, or Firm*—C. A. Phillips

[57] ABSTRACT

A road marker of resilient material having a circular base from which there centrally rises a resiliently mounted reflector. The upper side of the base is otherwise generally convex except that there are cut-out regions on opposite sides of the reflector and, upon impact, the reflector would be pushed into one of them, protecting it.

5 Claims, 6 Drawing Figures

REFLECTIVE ROAD MARKER

TECHNICAL FIELD

This invention relates to marking devices for making visible, particularly at night and in inclement weather, traffic markings, such as for marking a traffic lane or the edge of a road.

BACKGROUND ART

The most common form of traffic markers of the type applied to roadways is a painted line, typically either white or yellow. Lines suffer several disadvantages. They are often difficult to see in inclement weather, they tend to fade away due to weathering and traffic, and some vehicle operators, those suffering from nyctalopia, simply cannot see the lines at night. A long recognized alternative is to employ reflective markers attached to the highway, typically along a line otherwise marked by a painted line. Such markers generally have a low profile, a tapered surface, and are fairly rigid. Being rigid, there is a tendency for them to be driven into asphalt roadways, particularly in hot weather. Further, their reflective surface, a transparent material covering a reflective material, must sustain and absorb the full friction and impact of the wheels of motor vehicles, and the transparent material covering the reflective material is gradually scored, reducing its light transmission ability and thus the effectiveness of the marker.

DISCLOSURE OF THE INVENTION

In accordance with this invention, a road marker is constructed with a base having a generally flat underside adapted to be attached to the surface of a paved road. A reflective member is resiliently mounted to and rises from the base. A pair of shoulder regions are positioned along either side of the reflective member, and when it is forced down against the base, as by the wheel of a vehicle, the shoulder regions provide a bridge which effects protection of the reflective member.

DETAILED DESCRIPTION OF THE PREFERRED EMBODIMENT

Figure 2:
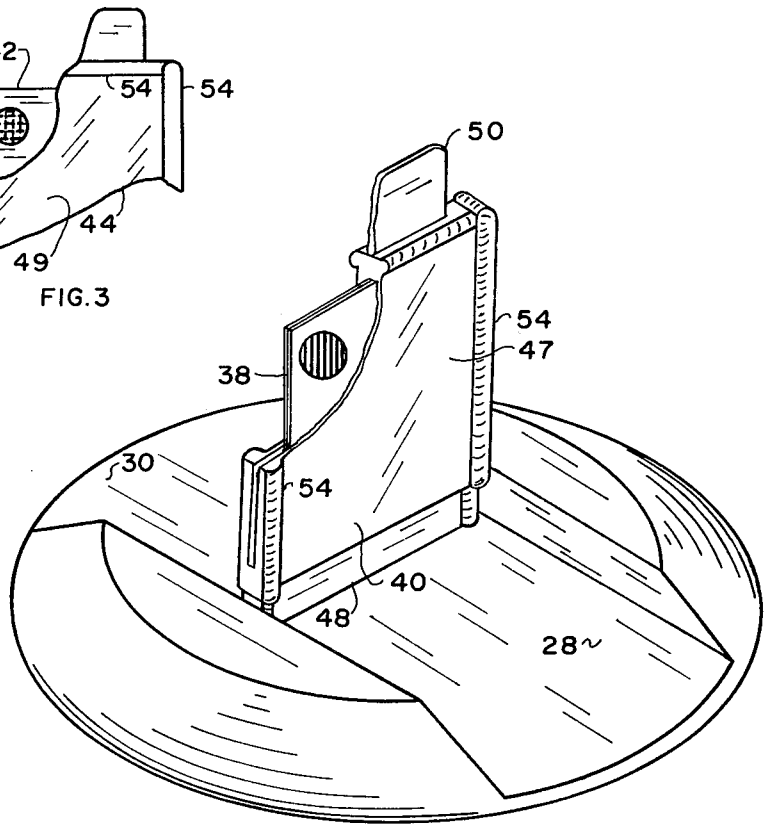
FIG. 2 is a pictorial view of the marker as shown in FIG. 1 with a portion removed to illustrate certain details of construction.
Figure 3:
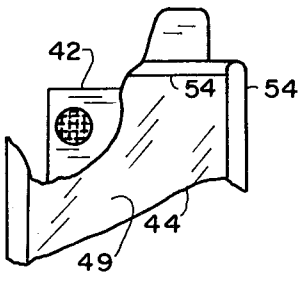
FIG. 3 is an elevational view of a portion of the marker shown in FIG. 2 and shown from an opposite side to illustrate a different colored reflective surface.
Figure 1:
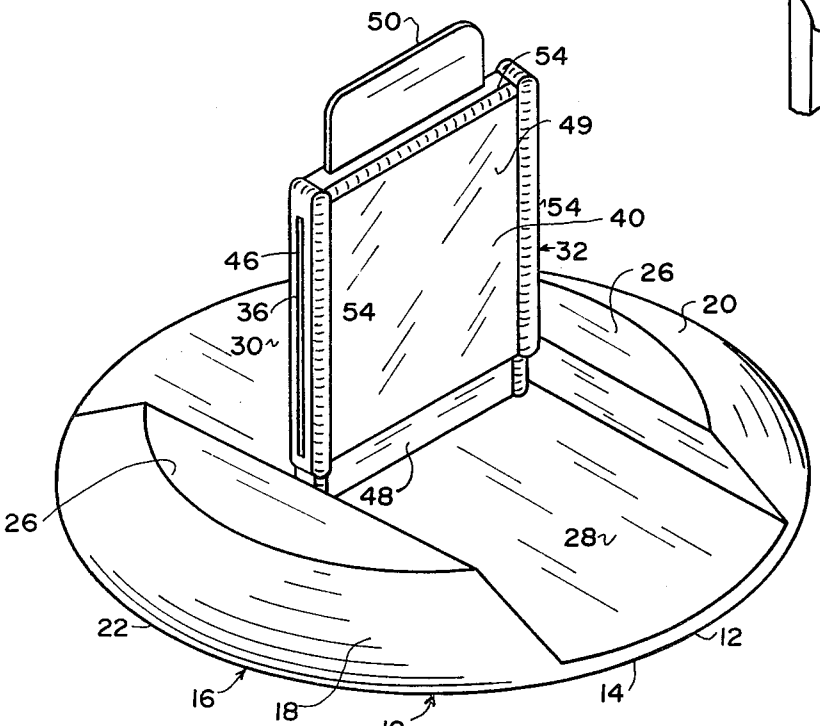
FIG. 1 is a pictorial view of a road marker as contemplated by this invention.

Referring to the drawings, a road or pavement marker 10 is formed, molded, from a generally transparent resilient material, such as polyurethane. It has excellent qualities of resilience and toughness. A circular base or base region 12 has a generally flat underside 14 which is attachable to a road pavement, typically asphalt or concrete, by means of a compatible adhesive, such as a two-part epoxy which will adhere to the pavement and to the polyurethane. A protective body 16 is formed of two body regions 18 and 20 with sloping sides which rise from edge 22 of base 12. The general configuration of the body is that of a truncated and slotted cone having flat, truncated, upper planar surfaces 26 and generally rectangular slots or openings 28 and 30 extending outward from the center to edge 22 of base 12.

A reflective display holder 32 is formed as an upward extension of base 12. It is generally rectangular and is formed with a slot 36 into which a sheet or sheets of an appropriately coated reflective material are positioned, examples being sheet 38 on side 40 displaying a red color, and sheet 42 on side 44 displaying an amber color. As positioned, outer transparent layers or windows 47 and 49 of holder 32 provide light transmission to and from the reflective sheets. Upon insertion, the openings 46 through which sheets 38 and 42 are inserted are appropriately sealed by an adhesive. Alternately, a reflective sheet or sheets may be molded into display holder 32.

Figure 4:
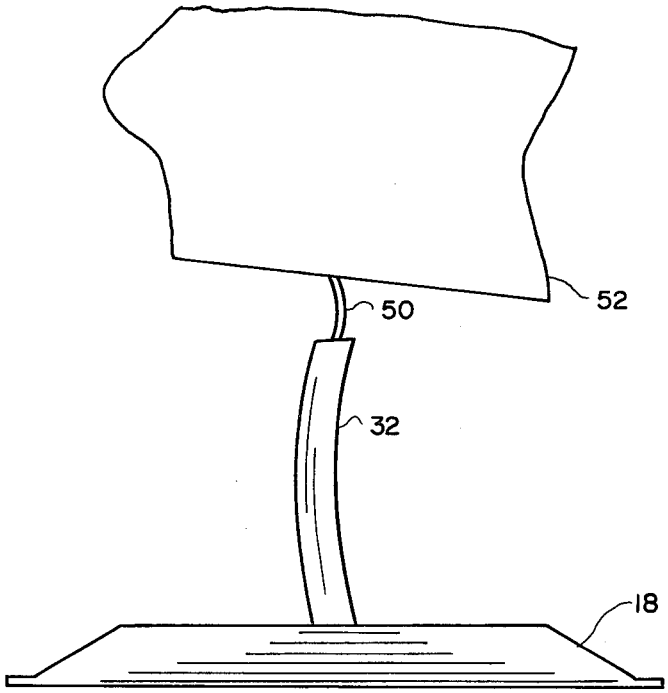
FIGS. 4–6 are side elevational views of the marker, illustrating, progressively, the effect of the marker being impacted, as by the tire of a vehicle.
Figure 5:
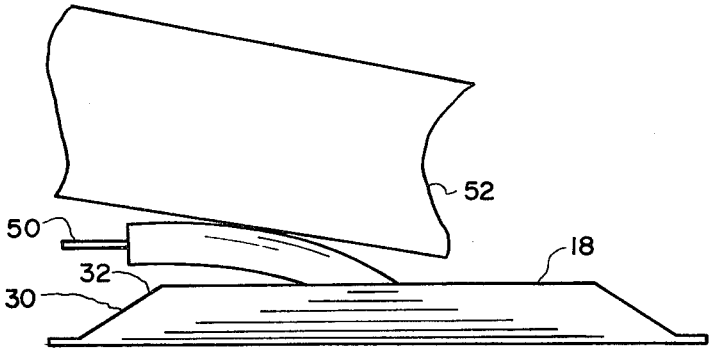
Figure 6:
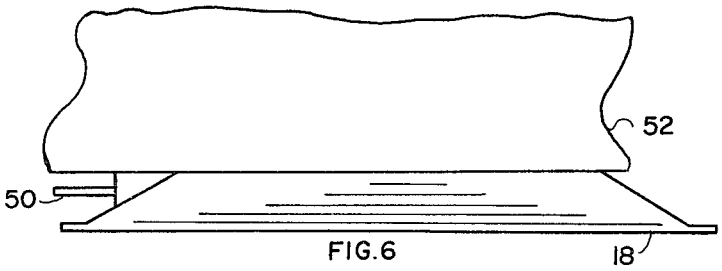

A lower support region 48 of display holder 32 is of reduced cross section as shown to provide a bending axis for display holder 32. When bent, as particularly illustrated in FIGS. 4–6, display holder 32 is forced down into slot 30 and, when bent in the opposite direction, the display holder is moved down into opposite slot 28.

Upper extension 50 of display holder 32, being of a resilient material, is formed of a thinner and thus more pliable material than the central region of display holder 32. Its function is to readily bend in one direction or the other (FIG. 4) when the wheel 52 of a vehicle strikes it and presses down on it. Thus, as shown, there is imparted a bending movement in one direction which then forces the display holder in general to bend in an opposite direction, forcing it into one of slots 28 and 30. When bent downward into one of the slots, the display holder presents a relatively low profile, enabling a vehicle wheel 52 to pass over it, and at the same time the display holder is generally protected by side regions 18 and 20 of body member 16.

To provide further protection of display holder 32, raised edges 54 on each side of display holder 32 tend to prevent abrasive effects on the transparent windows 47 and 49 by virtue of keeping the windows from being rubbed against the upper surface of the slot into which it is pressed, where grit, such as sand, pebbles, or other foreign matter, may be present. In this manner, the effective life of a marker is significantly lengthened.

In usage, road marker 10 will be typically placed along the center or side of a roadway to effect a traffic marking, for example, the red reflective side being viewable from a "wrong way" traffic movement direction, and the amber or silver colored reflector being positioned on the opposite and correct direction side for traffic movement. If a vehicle strikes a marker, it will generally be reflected down into slot 28 or 30, and a vehicle can run over the entire marker with a fairly minimum impact effect. Even if the movement of the vehicle is across the marker or at some angle between a normal approach and a direct side approach, display holder 32 will normally press down into a slot 28 or 30. This effect is aided by virtue of the resilient character of the display holder and also as described above by the separate and reverse bending extended or top portion 50 of the display which, when pressed directly from above or at some angle which includes a vertical component, causes the display to bend in one direction and generally forcing it downward into one of slots 28 or 30.

By virtue of the configuration shown, and constructed as described, road marker 10 is marketable for a price significantly less than previously known road markers of the character described above. It is constructed so as to have a very long life, and yet to retain essentially its full marking characteristics. While, as described, the principal usage contemplated is that as a one- or two-way traffic marker, it is to be appreciated that it can likewise be used wherever a reflective marker is to be affixed to a pavement or other flat surface. One such other example would be as an airport alignment marker, improving a pilot's depth of perception in landing operations.

I claim:

1. A road marker comprising:

a base having a generally flat underside adapted to be attached to a surface of a paved road;

a body region generally rising on an upper side from edges of said base;

an opening formed in the upper side of said body region;

a marker region extending upward normally from the base and from within said opening and rising above said body region, having a pair of opposite, generally flat sides, and the thickness of said marker region between said sides generally being no thicker than the maximum depth of said opening, and said opening appearing on directly opposite sides of said marker region and extending to the outer edges of said base, and each side configured to receive the full width of said marker region when bent toward said opening on either side of said marker region;

resilient support means coupling said marker region to said base, whereby impact on said marker region tends to cause said marker region to bend into said opening and thereby be protected by said body region;

a reflective material along at least one said genrally flat side of said marker region and being viewable as at least one of said genrally flat sides is viewed;

said body region extends upward on opposite sides and around said marker region between intersections with said opening and tapering upward from edges, whereby side impacts on lower portions of said marker region are prevented; and a top region rising from an upper edge of said marker region, and this top region being of a resilient material, whereby an impact upon said top region tends to cause it to bend and to cause the marker region to react to being tilted and to bend into said opening.

2. A road marker as set forth in claim 1 wherein said opening and said marker region are generally rectangular.

3. A road marker as set forth in claim 2 wherein said base and said marker region are of a resilient material.

4. A road marker as set forth in claim 3 wherein said resilient support means comprises a resilient material of reduced thickness to that of the adjacent thickness of said marker region.

5. A road marker as set forth in claim 4 wherein said marker region is of a generally transparent material and said reflective material is within surfaces of said transparent material.

* * * * *